United States Patent [19]

John

[11] 4,089,473

[45] May 16, 1978

[54] AGITATOR MILL

[75] Inventor: Willy John, Selb, Germany

[73] Assignee: Gebruder Netzsch, Maschinenfabrik, Selb, Germany

[21] Appl. No.: 732,769

[22] Filed: Oct. 15, 1976

[30] Foreign Application Priority Data

Oct. 15, 1975 Germany ..... 2546146

[51] Int. Cl.[2] ..... B02C 23/40

[52] U.S. Cl. ..... 241/41; 241/46.11

[58] Field of Search ..... 241/41, 42, 45, 46 R, 241/46.02, 46.11, 46.15, 46.17, 171, 172

[56] References Cited

U.S. PATENT DOCUMENTS

| | | | |
|---|---|---|---|
| 735,664 | 8/1903 | Gent | 241/41 |
| 2,954,173 | 9/1960 | Dunwody | 241/41 |
| 3,311,310 | 3/1967 | Engels et al. | 241/171 |
| 3,414,202 | 12/1968 | Gresch | 241/42 |
| 3,506,201 | 4/1970 | Engels et al. | 241/42 |
| 3,817,461 | 6/1974 | Geissel et al. | 241/73 |
| 3,937,406 | 2/1976 | Klimaschka | 241/46.11 |

*Primary Examiner*—Granville Y. Custer, Jr.
*Attorney, Agent, or Firm*—Karl W. Flocks

[57] ABSTRACT

An agitator mill with diluting medium injected into the grinding container at different spacings from the inlet of the container with dosing devices connected to dosing pumps, which dosing pumps are operated in synchronization with a charging pump via a common jackshaft whereby adjustment of the amounts of diluting liquid reaching the grinding space is made in accordance with the amount of material to be ground flowing through the grinding container.

9 Claims, 2 Drawing Figures

AGITATOR MILL

BACKGROUND OF THE INVENTION

In the chemical industry, foodstuff industry and dyestuff industry it is frequently necessary to mill granulate or pulverulent materials in the wet state and/or to disperse them in a liquid. This is normally done in agitator mills comprising a mostly cylindrical grinding container in which coaxially with the container an agitator shaft is arranged. Agitating elements are mounted to the agitator shaft. The grinding container is partly filled with hard grinding bodies being resistant to wear to a large degree, whose size is chosen in dependency upon the desired result of the grinding operation. The grinding container has an inlet and an outlet for the material to be ground, the inlet being at the bottom and the outlet at the top in most cases. Upstream of the outlet, a separating device is generally provided allowing only the ground material to pass but retaining the grinding bodies.

In the operation of such agitator mills difficulties may arise in that the viscosity of the material to be ground increases strongly during the milling operation since the liquid with which the solid particles have been wetted outside the agitator mill is not capable of forming a sufficient liquid film around each particle even when the same are more or less comminuted, and consequently their overall surface area becomes increasingly larger. When the viscosity of the material to be ground in the grinding container increases as the distance from the inlet increases this entails an increase of the shearing forces acting upon the material to be ground as a consequence of the relative movement thereof in respect to the agitating elements and the grinding bodies. During the grinding operation the material to be ground therefore takes up the more mechanical work per time and volume unit the more material to be ground moves away from the inlet. An undesireable consequence of this increased work take-up is a heating of the material to be ground which increases also as the distance from the inlet increases. In order to prevent that the material to be ground is damaged by overheating or that even waste is made thereof it is mostly necessary to reduce the rotational speed of the agitator shaft and/or the density of the grinding bodies in the grinding container and to pass the material to be ground in circulation several times through the grinding container and to dilute the material to be ground with a liquid each time before it enters the grinding container.

From German Pat. No. 1,607,441 an agitator mill has been known in which the difficulties described hereinbefore are lessened in that the grinding space is subdivided into two or more grinding chambers containing grinding bodies of different sizes and being separated from one another by at least one processing chamber free from grinding bodies. A conduit opens into the or each processing chamber through which air or a neutral, non-oxidizing gas, or any other treating medium or an additive is to be supplied into the material to be ground. The difficulties described cannot be avoided altogether thereby, however, since the highest heating of the material to be ground occurs in one of the grinding chambers where the grinding bodies are present and since only there a diluting medium can be mixed rapidily and thoroughly with the material to be ground.

SUMMARY OF THE INVENTION

One object of the invention is to provide an agitator mill for fine-grinding and dispersing a suspension of solids in a liquid, in which agitator mill local overheating of the material to be ground is prevented.

Another object of the invention is to enhance the efficiency of an agitator mill of the kind specified.

Still another object of the invention resides in making possible a complete milling and dispersing in only one circulation even of material that is difficult to process through an agitator mill of the kind specified.

These and other objects are obtained by our invention in that a plurality of injection means for injecting a diluting medium into the grinding container are arranged at different spacings from the inlet of said container, and that one dosing device each for the diluting medium is connected.

The term diluting medium as used in the present specification, comprises any chemically active or inactive flowable additive which is suited to be mixed with the material to be ground. The chemical properties of such additives will in each case depend on the type of treatment to which the material to be ground shall be subjected. For instance, for separating copper ore it is possible to mill a concentrate of copper pyrites in an agitator mill according to the invention, wherein an alkaline solution is introduced through the injection means. In other cases it will be useful to employ an acid as diluting medium and at the same time as chemically active processing medium.

The invention allows the various materials suited for being processed in an agitator mill to be maintained at a substantially constant viscosity during the grinding operation; the constancy being evidently the greater, the more injection means are arranged at different spacings from the inlet, and the more accurate the associate dosing devices are adjusted to one another. Due to the substantially constant viscosity of the material to be ground the efficiency of the agitator mill is substantially equally good in all regions of the grinding container, and local overheating is avoided.

In a preferred embodiment of the invention the dosing devices have dosing pumps synchronized with the charging pump. Thereby the amounts of liquid reaching the grinding space through the injection means are automatically adjusted to the amount of material to be ground flowing through the grinding container per one time unit. If the operation of the charging pump is interrupted, no diluting medium reaches the grinding container through the injection means. On the other hand, it is ensured that upon the charging pump resuming its operation the injection means become active at once.

BRIEF DESCRIPTION OF THE DRAWINGS

Further features of the invention result from the description of the preferred exemplary embodiment of the invention which is illustrated in the attached drawings.

DESCRIPTION OF THE PREFERRED EMBODIMENT

Figure 1:
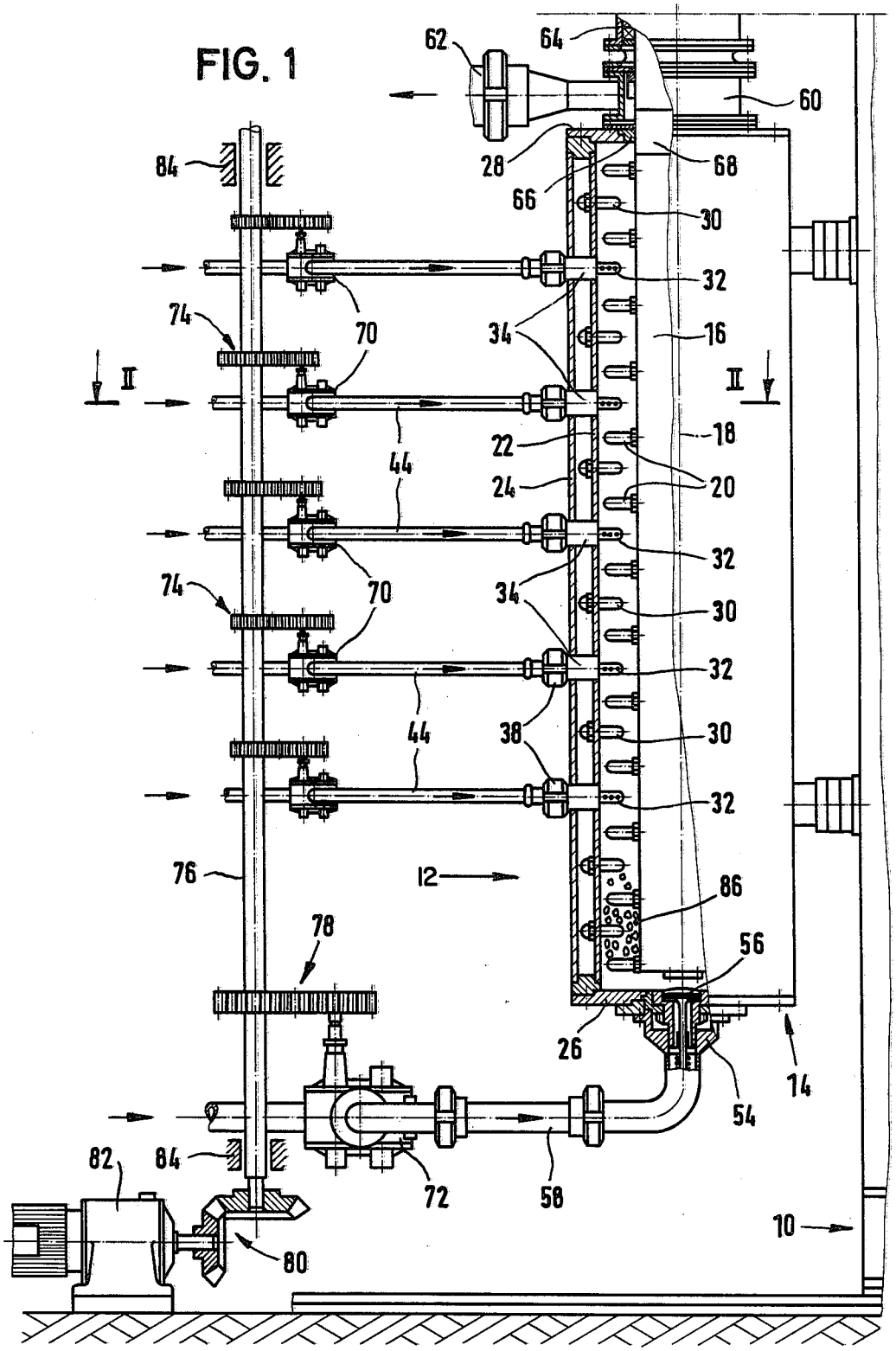
FIG. 1 is a vertical sectional view of parts of an agitator mill.

A vertical agitator mill is shown in the drawing whose main components are conventionally a stationary framework 10, an agitator 12 and a grinding container 14. The framework 10 is only partly drawn as it may be of conventional design as is e.g. described and illustrated in U.S. Pat. No. 3,937,406 to Klimaschka.

The agitator 12 comprises a hollow cylindrical agitator shaft 16 in the illustrated example having a vertical axis 18 and being rotatably supported in an upper part of the framework 10 (not illustrated) and arranged to be driven by an electric motor via a gearing likewise arranged in the framework. Agitating elements 20 fixed to the agitator shaft 16 define between them axial intermediate spaces. In the illustrated example the agitating elements 20 comprise a plurality of radially arranged rod-shaped agitating elements in each of a plurality of planes normal to the axis 18. Such an arrangement of agitating elements is e.g. known from my German Pat. No. 1,233,237. Other e.g. disc-shaped agitating elements can be provided as are known from U.S. Pat. No. 3,817,461 to Geissel et al. instead of the shown rod-shaped agitating elements 20.

The grinding container 14 has two concentrically arranged cylindrical walls 22 and 24, an annular bottom 26 and an annular cover lid 28, both being screwed to the walls 22 and 24. Rods 30 are secured to the inner wall 24 extending radially into the axial intermediate spaces between the agitating elements 20. Besides rods 32 are provided that are similar to the rods 30 as regards their shape and arrangement as far as they project inwardly from the inner wall 22; rods 32, however, are not secured to the inner wall 22 but are inserted from outside into a radial sleeve 34 each. Each of the sleeves 34 is tightly welded to the walls 22 and 24 and provided at its radial outer end with an external thread 36 onto which a screw cap 38 is screwed. Each of the hollow rods has at its outer end a flange 40 which jointly with annular seals 42 is tightly clamped between the outer end face of the associate sleeve 34 and the associate screw cap 38. A dosing conduit 44 is screwed to each screw cap 38 and thereby connected to the internal space 48 of the associate hollow rod 32.

Figure 2:
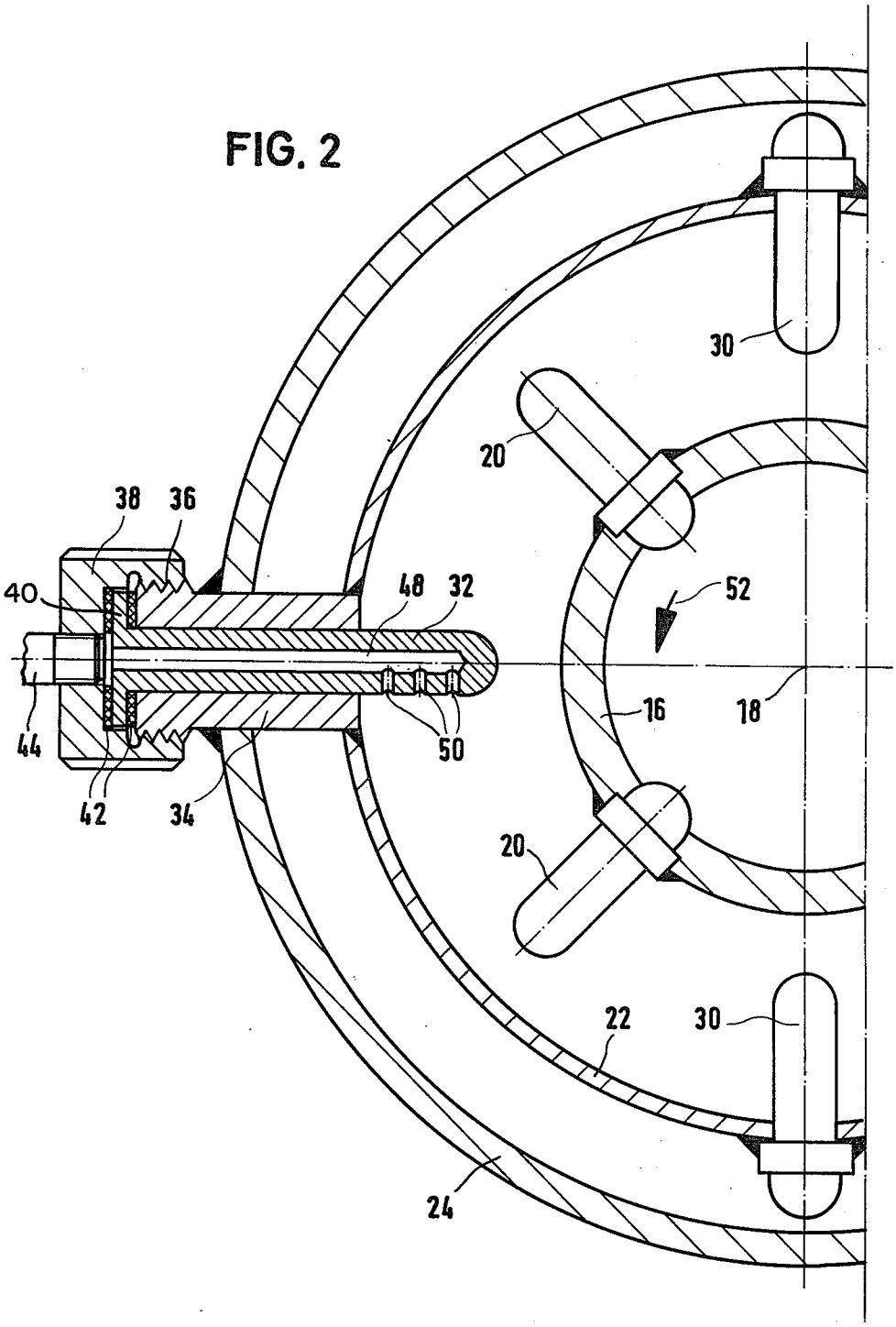
FIG. 2 is a strongly enlarged sectional view along line II—II in FIG. 1

Inside the inner wall 22 each of the hollow rods 32 has three injection nozzles 50 formed by radial bores. The injection nozzles 50 are arranged in a plane that is normal to the axis 18 in such a manner that the flow direction of a liquid discharged through the same substantially corresponds to the direction of movement of the agitating elements 20, when the agitator shaft 16 is driven in the direction indicated by an arrow 52 in FIG. 2.

An inlet 54 is fixed to the bottom 26 of the grinding container 14 containing a non-return valve 56 and being connected to a charging conduit 58.

A cylindrical housing 60 having an outlet 62 is mounted on the cover lid 28 of the grinding container 14. The agitator shaft 16 extends through the cover lid 28, the housing 60 and a shaft seal 64 mounted thereon. A separating ring 66 is secured to the inner edge of the cover lid 28 which together with an annular surface 68 of the agitator shaft 16 defines an annular separating gap therebetween. Said gap has a small width, i.e. a few thousandths of an inch, and therefore can not be seen in relation to the other parts in FIG. 1. Examples of this top structure are illustrated in British Pat. Nos. 1,331,662 and 1,416,509 by the present applicant.

Each of the dosing conduits 44 is connected to a dosing pump 70 and the charging conduit 58 is connected to a charging pump 72. The dosing pumps 70 are gear pumps in the embodiment shown and are connected to a common jackshaft 76 by a gear drive 74 each. The charging pump 72 is connected to the same jackshaft 76 by a gear drive 78. In connection with the invention a gear drive is to denote any drive that is suited to ensure a non-slip connection between the jackshaft 76 and pumps 70 and 72. The gear drives 74 and 78 having directly intermeshing (tooth) gears as shown may be replaced by other types of gear drives or transmissions e.g. gear-belt drives, gear-chain drives and other chain drives. The gears of gear drives 74 and 78 are exchangeable for other gears in order to change the transmission ratio of the said gear drives and thus change the output of closing pumps 70 and/or charging pump 72 with a given rotational speed of jackshaft 76. Also the gears may be exchangeable.

A further gearing 80 connects the jackshaft 76 with a motor 82. The gearing 80 in the shown embodiment is a bevel gearing but could also be any other gearing, e.g. a V-belt drive as this gearing need not be free from slippage.

The jackshaft 76 in the illustrated embodiment is arranged in parallel to the axis 18 at a relatively small distance from the grinding concontainer 14 so that the dosing conduits 44 as well as the charging conduit 58 are as short as possible. Two bearings 84 are indicated in FIG. 1 in which the jackshaft 76 is journalled. These bearings 84 are shown separate from the framework 10 only for the sake of clearness; the bearings 84 and the motor 82 are expediently mounted to the framework 10.

The described agitator mill works as follows:

Before starting the operation the internal space of the grinding container 14 is partly filled with grinding bodies 86 whose smallest dimension is greater than the width of the gap between the separating ring 66 and the annular surface 68. Subsequently the agitator 12 is moved and the motor 82 is switched on so that the charging pump 72 supplies material to be ground from a reservoir (not illustrated) through the charging conduit 58 and the inlet 54 into the internal space of the grinding container 14 while simultaneously all of the dosing pumps 70 supply a diluting medium from a container each or from a common container (not illustrated) through the dosing conduits 44 and the injection nozzles 50 into the internal space of the grinding container 14. The diluting medium need not be the same with all the dosing pumps 70; if desired, each dosing pump 70 can supply a different diluting medium. The material to be ground that is introduced through the inlet 54 is mixed with and comminuted by the grinding bodies 86 by the action of the agitating elements 20 and therefore the material to be ground is gradually moved upwardly in grinding container 14 whilst being wetted again and again by the diluting medium discharged from the injection nozzles 50 so that it substantially maintains its original viscosity.

During the operation a cooling agent flows through the annular space between the walls 22 and 24.

What is claimed is:

1. An agitator mill for fine grinding and dispersing a suspension of solids in a liquid comprising a grinding container having an inlet and an outlet for the suspension and further having injection means disposed between said inlet and said outlet for introducing a diluting medium, an agitator extending into said grinding container and being rotatable therein, a plurality of grinding elements arranged inside said grinding container and adapted to be moved by said agitator together with the suspension, and a charging equipment having a charging conduit leading to said inlet, a motor and charging pump connected to said charging conduit and driven by said motor, said injection means having at least one dosing pump synchronized with said charging pump.

2. The agitator mill of claim 1 wherein the dosing pumps and the charging pump are driven by the said motor via a common jackshaft.

3. The agitator mill of claim 2 wherein the jackshaft is connected to the dosing pumps and the charging pump by gearing.

4. The agitator mill of claim 3 wherein said gearing connecting said jackshaft to said dosing pumps and said charging pump has exchangeable gears.

5. The agitator mill of claim 1 wherein the dosing pumps are geared pumps.

6. The agitator mill of claim 1 wherein each injection means has at least one hollow rod extending substantially radially into the grinding space and each hollow rod has at least one injection nozzle.

7. The agitator mill of claim 6, the agitator comprising agitating elements projecting substantially radially away from an agitation shaft and defining between them axial intermediate spaces wherein said hollow rods extend into the intermediate spaces.

8. The agitator mill of claim 7 wherein the injection nozzles are arranged substantially tangentially with respect to the paths of motion of the agitating elements.

9. The agitator mill of claim 6, the agitator comprising rod-like agitating elements projecting substantially radially away from an agitator shaft and defining between them axial intermediate spaces wherein said hollow rods extend into the intermediate spaces.

* * * * *